US005979093A

United States Patent [19]

Harruff et al.

[11] Patent Number: 5,979,093

[45] Date of Patent: Nov. 9, 1999

[54] CHANGEABLE INFORMATION SCROLL SIGN MODULE

[75] Inventors: Robert J Harruff, Pewaukee; Philip R Gross, Brookfield, both of Wis.

[73] Assignee: Everbrite, Inc., Greenfield, Wis.

[21] Appl. No.: 08/990,113

[22] Filed: Dec. 12, 1997

[51] Int. Cl.[6] ..... G09F 11/18

[52] U.S. Cl. ..... 40/471; 40/518; 242/412.1; 242/416

[58] Field of Search ..... 40/471, 518, 519, 40/520, 521, 522, 523; 160/241, 313; 242/412.1, 416, 538.1

[56] References Cited

U.S. PATENT DOCUMENTS

| | | | |
|---|---|---|---|
| 797,097 | 8/1905 | Chapman | 40/471 |
| 1,042,519 | 10/1912 | Wotherspoon | 40/471 X |
| 1,214,962 | 2/1917 | Skreta | 40/471 |
| 2,182,084 | 12/1939 | Keilwagen | 40/471 |
| 3,293,782 | 12/1966 | Drexler | 40/471 |
| 3,447,252 | 6/1969 | Laney, Jr. | 40/471 |
| 3,761,890 | 9/1973 | Fritts et al. | 40/518 X |
| 5,003,717 | 4/1991 | Trame et al. | 40/471 X |
| 5,673,504 | 10/1997 | Brown | 40/471 X |

*Primary Examiner*—Brian K. Green
*Attorney, Agent, or Firm*—Ryan Kromholz & Manion

[57] ABSTRACT

A web tension maintaining roll in a scroll sign module is arranged with its axis parallel to a rotatable second roll, both rolls being arranged for rotation between laterally spaced apart side frame members. For each roll, a short shaft projects from opposite side frame members toward each other for the roll to rotate about the common axis of the shafts. A motor driven drive shaft whose axis is transverse to the axes of rotation of the rolls has a worm fastened to the shaft adjacent each of the rolls. The worms are drivingly engaged, respectively, with worm wheels that are supported for rotation about the axis of the short shafts and about the rotational axis of the rolls. The worm wheel for the tension roll is coupled in driving relationship to the tension roll by way of a spiral spring whose inner end is connected to the worm wheel and whose outer end is connected to the tension roll. The motor driven main drive shaft has a knob on at least one end or a cable connection that provides for turning the main drive shaft manually to provide the option of manual operation or motor operation of the sign module. The worm and worm wheel roll drive mechanism precludes roll backlash.

23 Claims, 4 Drawing Sheets

CHANGEABLE INFORMATION SCROLL SIGN MODULE

BACKGROUND OF THE INVENTION

The invention disclosed herein pertains to a scroll sign module comprised of two rolls that are mounted between the sides of a frame in spaced apart relationship for rotating bidirectionally about parallel axes to wind an information bearing web onto one roll as the web unwinds from the other roll.

Roll sign modules have various applications including, but not limited to displaying prices of goods or services or other information that must be readable from a substantial distance. Displaying the price of vehicle fuel is a typical use of such modules. In this use, several modules are arranged in juxtaposition, to compose the price of fuel, and are mounted on a pole at a great height adjacent a highway for being visualized by vehicle drivers at a great distance from the sign installation site.

Several types of scroll sign modules are known. A typical module has an electric motor operatively coupled in driving relation with two spaced apart parallel rolls by means of a suitable mechanism including gears, chains, sprockets, toothed belts and pulleys. Typically, at least one roll in a parallel pair is coupled to a driving source inelastically for positive driving and the other roll in a pair is a so-called tension roll that is driven rotationally through the agency of an elastic device such as a helical or spiral spring. The spring that is coupled to a driven axle and the tension roll provides for maintaining a substantially constant tension in that part of the indicia displaying web which is stretched between the two rolls even though the overall diameter of the rolls plus the web wrapped on them increases on one roll and decreases on the other roll as the web is wound and unwound, respectively.

U.S. Pat. No. 734,982, which was granted to Smith on Jul. 28, 1903, discloses a scroll module wherein a tension roll is journaled for rotation on a rotationally driven shaft. A spiral spring is installed in a cylindrical recess in the end of the tension roll concentrically to the roll driving shaft that extends through the recess. The inside end of the spiral spring is attached to the shaft and the outside end is attached to the roll so that when the shaft rotates the tension roll is driven elastically by way of the spiral spring. The shaft for the tension roll and the other cooperating roll are provided with sprockets for being driven with a chain that is translated by sprockets on the shafts of the rolls and an electric motor. In this patent, the mechanism includes a lead screw operated with a chain and gear system to switch the take-up roll to becoming the unwind roll for the web and, vice versa, when the end of the web is reached.

Among the problems of driving the rolls of a sign module with chains and sprockets is that these components must be lubricated regularly to maintain good operation and inhibit corrosion. Applying lubricant to the components of a sign that is mounted on a tall structure is an inconvenient and unpleasant task. Dripping of lubricant which is commonplace with chains is another problem. Chains also have the undesirable characteristic of becoming less flexible when the ambient temperature drops to below zero degrees on the Fahrenheit scale, which is not uncommon during the winter in the northern states. A stiff chain reassures a greater force to bend it around the sprockets which can result in overloading the motor.

A loose chain may come off the sprockets and an excessively tight chain may impose a greater load on the small electric motor that drive a sign of this type.

U.S. Pat. No. 4,773,176, which was granted to Grehan on Sep. 27, 1988, also drives a tension roll in a sign module by way of a spiral spring. In this patented design, the tension roll has internal bearings for turning on a shaft which has an axial length that is greater than the axial length of the roll so one end of the shaft extends axially from the roll. The rolls in the module are driven with a flexible toothed belt running on toothed pulleys. A toothed pulley fits on the end of the tension roll shaft. The pulley has a large axial counterbore in which there is a spiral spring arranged concentrically to the shaft with the inside end of the spiral spring attached to the shaft and the outside end fastened to the toothed pulley. Hence, when the pulley rotates it causes an elastic or yieldable torsional force to be applied to the shaft so the shaft and roll can change their angular relationship to compensate for the overall change in the diameter of the roll and the web thereon that results from the amount of web on one roll decreasing while increasing on the other roll.

One problem that is inherent in modules driven with a toothed belt is that thermal expansion of a belt differs substantially from the thermal expansion of the metal frame that supports the components of the module. Hence, at low ambient temperatures, the toothed belt may become too loose and at high temperatures the belt may become too tight. An excessively tight belt can impose a large radial load on the motor and the bearings for the rolls and a loose belt can become unmeshed from the toothed pulleys. Moreover, in cold weather toothed belts become stiffer and require increased force to bend around the pulleys. This also imposes a greater load on the motor which could make the module inoperative under certain temperature conditions.

U.S. Pat. No. 3,255,541, which was granted to B. H. Bettcher on Jun. 14, 1966, discloses another version of a scroll module. In this patent a web tension maintaining roll has stub-axles extending axially inwardly by a short distance at opposite ends of the roll. The stub-axle at the driven end of the roll extends coaxially from a pinion gear that is driven by a motor driven gear train. A helical spring is mounted concentrically to the stub-axle. One end of the helical spring is attached to the driven stub-axle and the other end of the spring is attached to the roll to thereby provide an elastic connection between the power driven stub-axle and the roll to compensate for the changing overall diameter of the web on the roll as the web is transferred between the parallel arranged tension and cooperating rolls. The Bettcher patent module would have the problems incident to driving the rolls through a gear, sprocket and chain arrangement as has been explained.

U.S. Pat. No. 5,673,504 which was granted to Brown on Oct. 7, 1997, also discloses a module wherein a tension roll is driven elastically through the agency of a spiral spring. In this patented design a module is comprised of the usual laterally spaced apart frame members between which two web winding and unwinding rolls are positioned. To provide for rotation of the tension roll, bearing members are fixedly mounted in each of the spaced apart module frame members in coaxial relationship. The bearing members each have a central bore constituting an inside bearing or bushing for an axle and have a smooth concentric periphery constituting an outside bearing on which an end cap for the roll can rotate. The end cap contains an annular recess for containing a spiral spring that is positioned inside of the roll. A pulley for driving the roll rotationally with a belt is positioned outside of the frame member and a stub-axle that is unitary with the pulley extends axially from it for being journaled in the bushing and for extending into the spring recess in the end cap to provide for connecting the inside end of the spiral spring to the stub-axle and the outside end of the spring to the end cap. Since the end cap is latched to the roll, when the stub-axle is driven rotationally by means of the belt and pulley, a torsional force is applied to the end cap through the spring for rotating the tension roll. There is no simple way of providing for manual operating means in this patented design nor is backlash assuredly prohibited.

The module design first discussed has the disadvantages of being belt driven as previously explained. Moreover, the drive pulley for the tension roll and the pulley for the cooperating roll are outside of the module frame member so the modules must be undesirably spaced apart from each other by at least the width of a pulley when the modules are juxtaposed to compose a sign.

Additional patent references that disclose driving a tension roll in a module through the agency of a helical spring are U.S. Pat. No. 4,110,925 which was granted to Strand et al. on Sep. 5, 1978 and U.S. Pat. No. 1,902,884 which was granted to Wagner on Mar. 28, 1933.

The foregoing observations about preexisting scroll sign modules reveals that they are not optimized for trouble free operation. As explained, chain and belt drive systems are often adversely affected by changes in temperature wherein the chains or belts may stretch excessively, contract excessively, become stiff or too soft, or possibly drip oil as a result of requiring regular lubrication. It will be evident from inspection of the arrangement of the parts in pre-existing modules that differential expansion and contraction can occur that can prevent consistent module operation through a range of temperatures. Also, when timing belts and chain drive systems are used, an inventory of different sizes of belts or chains must be kept to cover changes in module sizes. Thus, according to prior practice, each module size requires individual parts that are not exchangeable between modules of different sizes. Pre-existing belt and chain drive systems also will have the inherent problem of allowing the web to relax, that is to lose tension, in the information display area between the tension roll and its cooperating roll due to backlash of such flexible drive systems.

Another limitation in pre-existing roll sign module drive systems is that they can be operated only with a motor and are without means for advancing the web in one direction or the other manually. In pre-existing designs, it is necessary, but not really practical, to grasp a chain or a belt and pull on it to translate it and thereby turn over the gear or sprocket system that is required for driving the web rolls rotationally.

SUMMARY OF THE INVENTION

The new sign uses some parts that have been used in pre-existing module designs including laterally spaced apart frame members with a pair of web winding and unwinding rolls arranged between them. The axes of the rolls are parallel to each other. One of the rolls is designated a tension roll driven through a spring and the other is a positively driven cooperating roll. According to the invention a small electric motor is mounted adjacent one of the side frame members between the members and drives a gear train. The gears rotate a main drive shaft that extends perpendicular to the rotational axes of the individual rolls in a cooperating pair of rolls. According to the invention, however, where the shaft crosses the axis of a roll, the shaft is provided with a worm that is subject to being driven with the main shaft in either rotational direction. For each roll short non-rotatable shafts are mounted fixedly in each of the side frame members in coaxial relationship and extending toward each other. A worm wheel is journaled for rotation on the short non-rotating shaft that supports the driven end of the tension roll. One of the worms on the main drive shaft engages with the worm wheel for driving it rotationally. An end cap for the tension roll is also journaled for rotation on the non rotating short shaft. The end cap is latched in driving relationship with a hollow cylindrical roll on which the web winds and unwinds. The end cap has a cylindrical cavity that is occupied by a spiral spring. There is an axial extension from the worm wheel to which the inside end of the spiral spring is attached while at the same time the outside end of the spiral spring is engaged with the end cap so as to drive the tension roll by way of torsional forces transmitted through the spring. The spiral spring constitutes an elastic connector between the worm wheel and the roll.

The non-driven or idler end of the tension roll is occupied by an end cap that is the same as the end cap that is inserted in the driven end of the roll that contains the spiral spring. The idler end is, of course, supported on a non-rotating short shaft.

A feature of the drive system for the rolls is its capability for preventing backlash of the rolls when driving them in either direction is discontinued. This is achieved by having the rolls driven with a worm and cooperating worm wheel. If the worm turns, it can drive the worm wheel. On the other hand, if an effort is made to rotate the roll or if it would be inclined to have backlash when it is driven to a stop, no reverse rotation of the worm can occur because a worm wheel cannot be rotated to drive a worm rotationally.

The roll, called the second roll, that cooperates with the first or tension roll in the process of winding and unwinding web between the rolls is driven inelastically with the worm and worm wheel driving elements. The driving arrangement for the second or cooperating roll is the same as the worm and worm wheel arrangement for the tension roll except in the case of the second roll a disk is substituted for the spiral spring. The disk is engaged drivingly by the axial extension of the worm wheel and has radially outwardly extending projections that extend through suitable openings in the end cap so the roll turns because it is engaged with the end cap and the end cap is engaged with the disk that is driven by the worm wheel.

The motor driven main drive shaft on which the worms are fastened at its opposite ends extends beyond the diameters of the first or tension roll and the second or cooperating roll. This allows fastening a flexible cable or the like to either or both ends of the motor driven main shaft so that the shaft can be turned manually to cause indicia on any part of the web to be positioned in the display area between the first and second rolls.

Thus, the design is distinguished by avoiding the use of pulleys driven by flexible belts, and sprockets driven by chains. It is further distinguished by having the capability of prohibiting backlash and reverse rotation of the rolls by any means other than by power derived from the electric motor of by manual power applied by rotating the main drive shaft through the agency of a flexible cable or a knob fastened to the drive shaft. The design provides for making modules of large and small sizes with essentially the same drive components for each size although lengthening or shortening the main drive shaft and, possibly, the length of the side frame members to which the rolls are mounted for rotation may be necessary.

An important feature of the new module is that it is immune from the effects of ambient temperature changes due to its all metallic construction and the ability of the worm and worm wheel drive to remain meshed even if there is some dimensional change in the drive worm centers.

A further feature of the new module design is that the moving parts including the rolls, worms, worm wheels and motor driven main drive shaft are all within the confines of two laterally spaced apart side frame members. Hence, the modules can be arranged very close to each other to yield the beneficial aesthetic effect of the characters on the respective webs being properly close to each other rather than being stretched out by a greater distance than the eye intuitively desires to perceive.

How the foregoing features and objectives of the invention are implemented and achieved will appear in the more detailed description of a preferred embodiment of the invention which will now be set forth in reference to the accompanying drawings.

DESCRIPTION OF THE DRAWINGS

FIG. 7 shows the worm and worm wheel drive arrangement for the second roll in a pair of cooperating rolls for handling one web, this section having been taken on a line corresponding to the line 7—7 in FIG. 2;

FIG. 9 is a fragmentary partial section taken on the line corresponding to the line 9—9 in FIG. 3 and showing the details of an idler web guiding roll.

DESCRIPTION OF A PREFERRED EMBODIMENT

Figure 1:
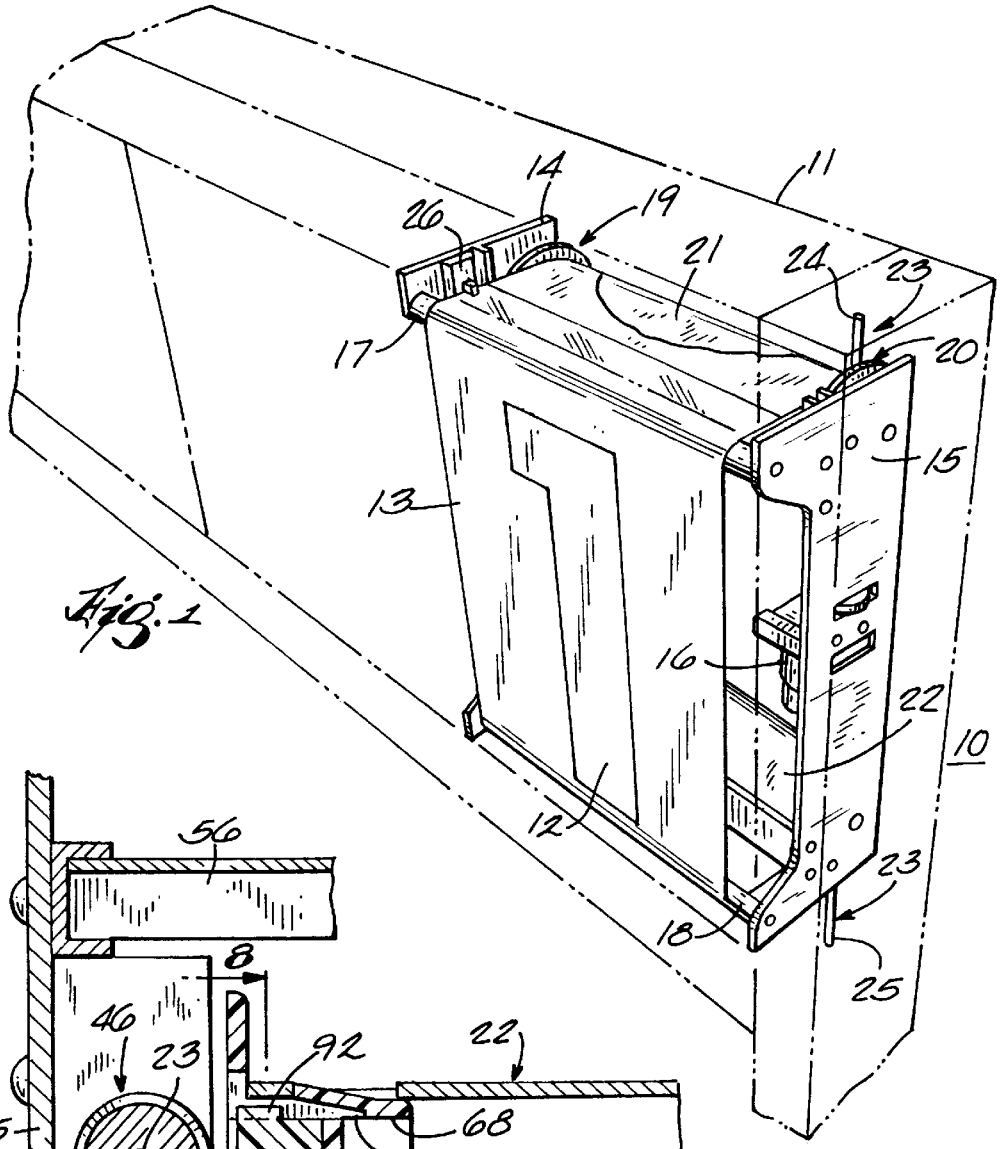
FIG. 1 is a front perspective view of the new sign module showing its side frame members, a partially exposed tension roll, a reversible electric motor and an indicia or information carrying web.

Attention is invited to FIG. 1 which shows a front perspective view of one of the new scroll sign modules 10, depicted in solid lines, in conjunction with a housing 11 depicted in phantom lines, to illustrate that the sign modules are usually arranged in juxtaposition within the frame and that, together, they may represent the price of a commodity, such as gasoline, the characters for composing a word or words or other types of graphics. A typical indicia or bit of information is the numeral "1" marked 12 on the taut web section 13. Basic components of the sign module depicted in FIG. 1 are the left and right laterally spaced apart side wall or frame members 14 and 15, a reversible electric motor 16 and upper and lower idler or guide rolls 17 and 18. Web 13 is usually a plastic film which bears indicia or other information such as the numeral that is marked 12. The indicia are usually translucent on a contrasting colored background to enable visualizing the indicia in ambient darkness by backlighting the web.

FIG. 1 also illustrates the parts of the circular roll end caps 19 and 20 which fit into the ends of the partially exposed first or tension roll 21 of the module. The second cooperating roll is partially exposed behind the web and is marked 22. These rolls and their associated parts will be described in more detail later.

It should be understood that either the first roll 21 or the second roll 22 in a cooperating pair may be endowed with the properties of a tension roll. The multiple roll main drive shaft 23 also has its upper and lower ends 24 and 25 exposed in FIG. 1. A photosensitive code reader device 26 is also partially exposed in FIG. 1. This device has the capability of reading information such as a bar code marked on the edges of the web to produce a signal indicating the position of a section of the webs to a remote operating station, not shown. One suitable system for determining and setting web position is described in U.S. Pat. No. 5,003,717 which is assigned to the assignee of the present application and is incorporated herein by reference.

Figure 2:
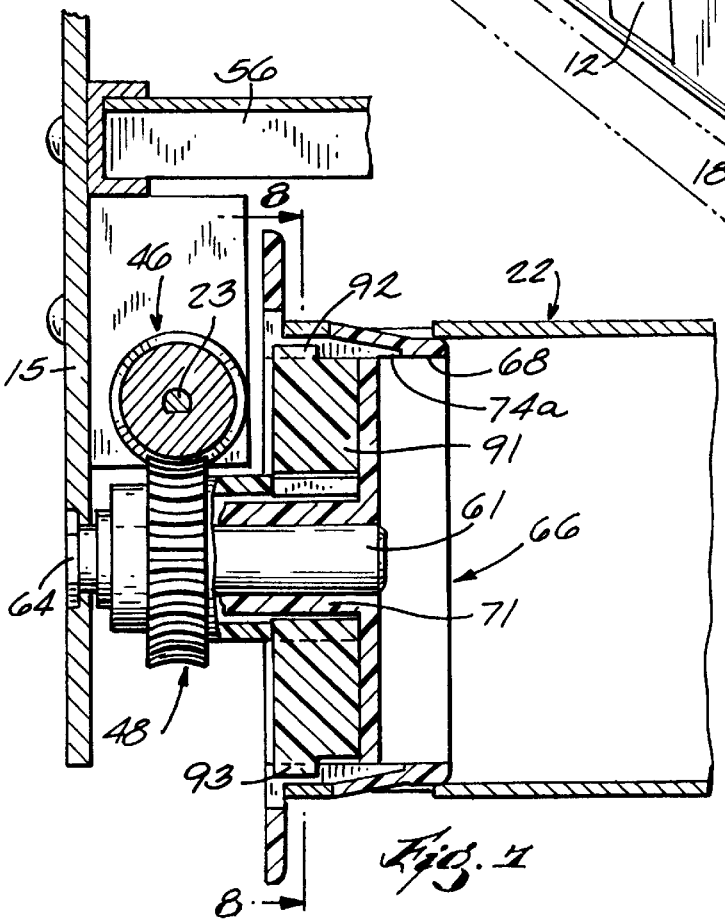
FIG. 2 is a rear elevational view of the sign module showing the upper or first tension roll and the lower or second cooperating roll on which the information bearing web winds and unwinds, a reversible motor, a drive shaft with worms and cooperating worm wheels and flexible manually operable shaft attachments.
Figure 2:
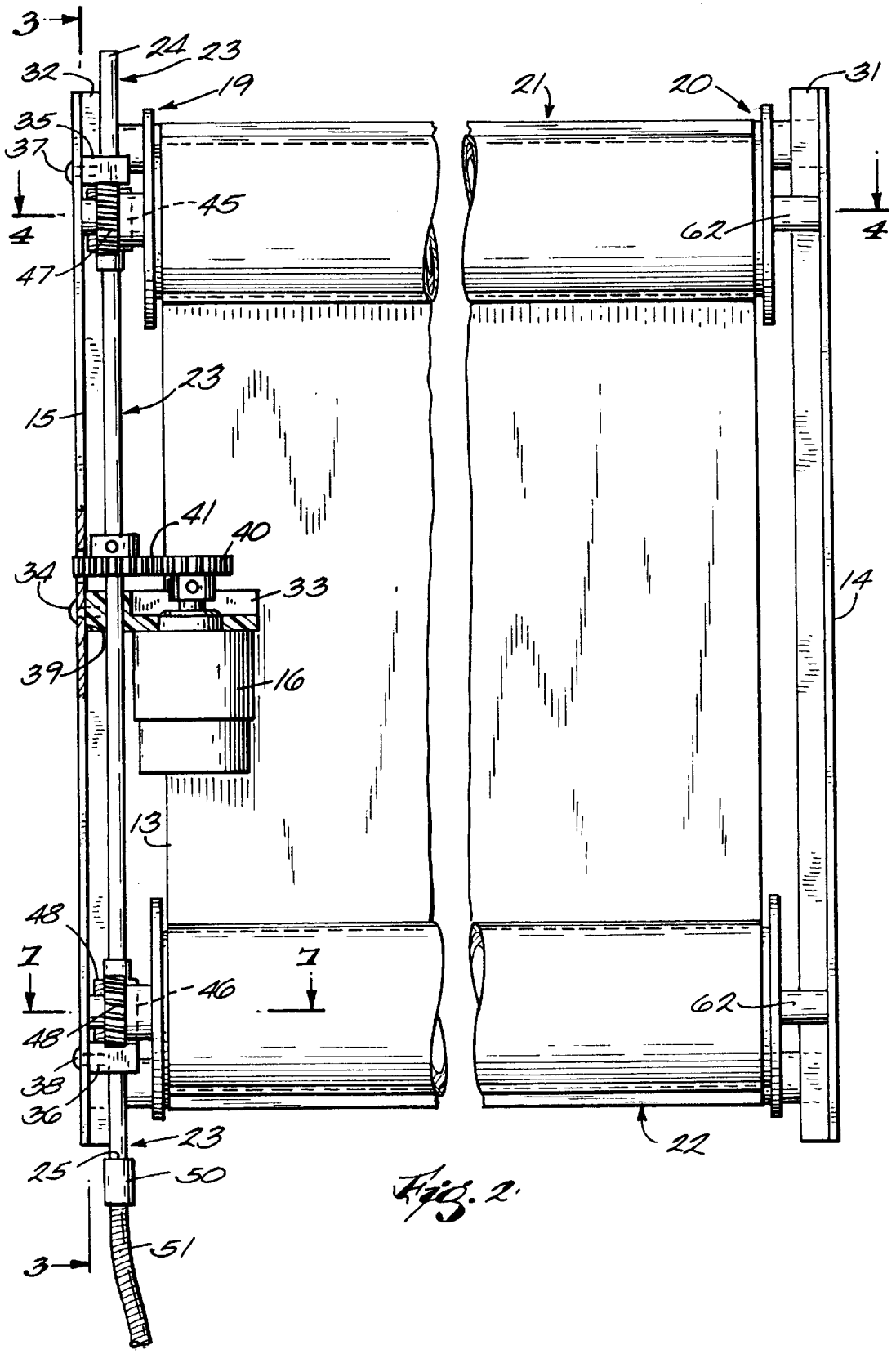
Figure 2:
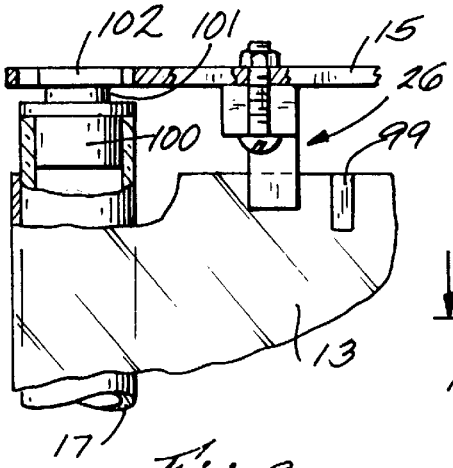

In the FIG. 2 rear elevational view of the scroll module, the first or tension roll 21 and the second or cooperating roll 22 are visible in their entireties. Here one may see that there are metal channel members 31 and 32 fastened to side frame members 14 and 15, respectively. Channel members 31 and 32 can be extruded with the side frame members 14 and 15 or they can be made individually and fastened to the side frame members by welding, riveting, or other suitable means. FIG. 2 shows that the single electric motor 16 for rotating the web rolls is mounted to a bracket 33 which is, in turn, mounted to side frame member 15 with screws such as the one marked 34. The long main drive shaft 23 that drives the first and second rolls 21 and 22 rotationally is journaled in upper and lower pillow blocks 35 and 36 which are fastened with screws 37 and 38 to the side frame member 15. The main drive shaft 35 may also be journaled at its midsection 39 in the molded plastic motor support member 33. There are cooperating screws, not visible, adjacent screws 37, 34 and 38 for preventing the pillow blocks 35 and 36 and motor support member 33 from twisting and causing misalignment with the main drive shaft 23.

Main drive shaft 23 is driven rotationally by a wheel train composed of a pinion 40 fastened to the shaft of motor 16 and meshed with a wheel 41 that is fastened to main drive shaft 23. Worms 45 and 46 are fastened coaxially to main drive shaft 23 at or near its opposite end portions 24 and 25 and adjacent the first roll, that is, the tension roll 21 and adjacent the cooperating second roll 22 for the web. Upper worm 45 adjacent the tension roll 21 is engaged in driving relationship with a worm wheel 47 which is involved in rotating tension roll 21 as will be explained in more detail momentarily. The lower worm 46 is engaged with a worm wheel 48 that is identical to worm wheel 47 and is involved in driving the second roll 22 as will be discussed in more detail later.

It will be explained in detail hereinafter that there is a significant advantage in driving the first and second rolls 21 and 22 rotationally with worm and worm wheel combinations in that driving can only take place in the direction of the worm-to-worm wheel and thus cannot backlash oppositely for the worm wheel to drive the worm since that would require some rotation of the worm wheel which is impossible because it is blocked by the worm with which it cooperates. This is an important feature in keeping the web 14 taut in a design such as this where the tension roll 21 is driven by means of a spiral spring, not shown in FIG. 2, which is indirectly coupled to worm wheel 47 and to the roll itself where the spring, as will be described later, provides an elastic connection between the driving worm wheel and the roll.

In FIG. 2, the lower end 25 of the main drive shaft 23 is coupled by means of a coupling 50 to a manually turnable flexible shaft 51. The flexible shaft provides for turning main drive shaft 23 about its axis for the purpose of turning the first and second rolls 21 and 22 rotationally in either one of opposite directions without using the motor or in the absence of a motor. In some models of the module coupling 50 and operating cable 51 are not present but, instead, the coupling is replaced by a knob or thumb wheel, not shown, for turning main drive shaft 23 in either direction to rotate the web carrying rolls 21 and 22. Note that the upper end 24 of main drive shaft 23 is also accessible for fastening a cable such as cable 51 by means of a coupling 50 to the main drive shaft 23 for turning the shaft. The upper end 24 of the shaft 23 could also be provided with a thumb wheel for turning the shaft.

Thus, where the sign is composed of a plurality of modules which, together, spell out a word, price or graphics are positioned at near ground level or within easy reach of a short ladder, a model of the sign employing the manually operated cable 51 or a knob would be appropriate. Of course signs composed of modules of the general type disclosed herein are often supported on tall columns to exhibit the price of gasoline, for example, so that the price may be seen by a distant driver on a freeway. In such installations, information composed by the indicia on the individual webs 13 of several juxtaposed modules is changed by translating the webs with a remote ground level keyboard and a microprocessor based control system which positions each information panel precisely where it can be read without being concealed by the framework of the housing for the several juxtaposed modules.

Figure 4:
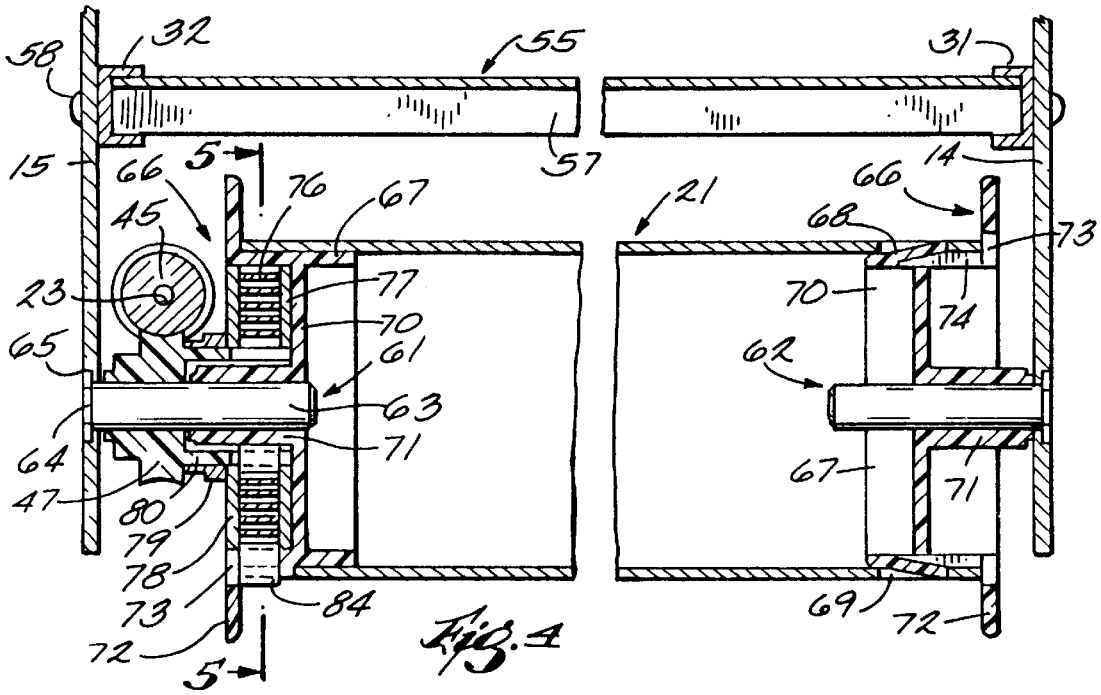
FIG. 4 is a sectional view taken on the line corresponding to the line 4—4 in FIG. 2, looking downwardly on the web tension maintaining first roll of the module.

The side members 14 and 15 of the module frame are tied together with cross members such as the upper cross member 55 shown in FIG. 4 and lower cross member 56 as shown in FIG. 7. In an actual embodiment of the module, the cross members 55 and 56, the two side frame members 14 and 15, the two rolls 21 and 22 and channels 31 and 32 are made of the same material having the same thermal coefficient of expansion. Thus, the parts expand and contract proportionately with ambient temperature changes so that binding of the moving parts in the module is eliminated. As shown in the FIG. 4 top plan sectional view, the opposite ends of cross member 55 terminate in channels 31 and 32. Typical cross member 55 has two sets of slightly spaced apart ribs, such as the one marked 57 on cross member 55 extending over the entire length of the cross member. The ribs are spaced such that they provide a seat for a self-tapping screw such as the screw marked 58 in FIG. 4 which is driven between the ribs. These screws fasten the side members 14 and 15 to their cross members.

Figure 6:
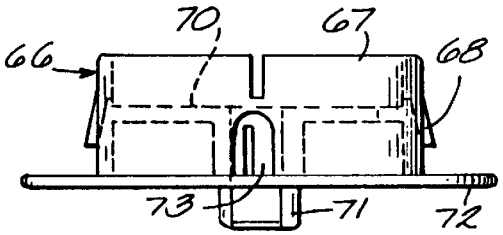
FIG. 6 is a side elevational view of an end cap that latches into the end of a cylindrical roll.

Most of the details of the tension roll 21 drive mechanism may be seen in FIG. 4 to which attention is now invited. This figure shows that the tension roll 21 is journaled for rotation on non-rotatable short coaxial, preferably identical, shafts 61 and 62. Typical shaft 61 has a cylindrical body 63 which may be solid or tubular. A hexagonal head 64 is formed integrally with the body 63 so that the shaft is composed of a single piece of metal. To mount the shaft in cantilever fashion as it appears, the first operation is to drill a round hole 65 in side wall frame member 15, for example. In the module described herein, frame member 15 is preferably composed of aluminum which is relatively soft compared with the metal composing shaft 61. With an appropriate die, not shown, the hexagonal head 64 is pressed into the round hole 65 in which case the hole deforms and the frame plate 15 metal cold-flows and assumes the shape of the hexagonal head 64 to thereby tightly bond the head into the frame member 15. The head has a shallow groove about its perimeter into which the aluminum flows. The shafts 61 and 62 are known as standoffs and are commercially available. Identical end caps 66 are fitted into opposite ends of roll 21. The cross sectional configuration of the end cap 66 at the right end of roll 21 is the most easily visualized of the two end caps when they are installed. The outside profile of the end caps 66 is shown in FIG. 6. As between FIGS. 4 and 6 one may see that the end caps have a mostly cylindrical body 67 having springy locking tabs 68 projecting radially outwardly of the end cap body 67. When the end cap is being pushed into the roll the tabs 68 are deflected inwardly. When the end cap becomes fully inserted in the roll, the tabs spring outwardly and latch into slots 69 in the periphery of roll 21, for example. Interiorly of the end cap body 67 there is a diametrically extending web 70 from which a hub 71 extends axially. The hub serves as a bearing for journaling the end cap and, hence, the roll on shafts 61 and 62. The end caps are provided with a flange 72 that serves to retain the web that runs on the roll in proper alignment with the roll. Note that there is an opening 73 in the end caps which is provided for obtaining access to the inside hooked end of a spiral spring 76 which will be discussed next primarily in reference to the left or driven end of the tension roll 21 in FIG. 4.

As shown in FIG. 4, the previously mentioned driven worm wheel 47 is journaled for rotation on non-rotatable shaft 61. Worm 45, which is fixed on the main motor driven drive shaft 23, has its helical teeth engaged in driving relationship with worm wheel 47. A spiral spring 76 is positioned within end cap 66 concentric to short non-rotatable shaft 61. A metal disk 77 is set in a spring cavity of the end cap 66 for assuring that the edges of the spring will not score the face of the softer plastic web 70 in the end cap. A spring retainer disk 78 composed of metal is set in the cavity occupied by the spring 76. A spacer ring 79 is interposed between the radially extending part of worm wheel 47 and disk 78 for retaining spiral spring 76 against axial movement.

Figure 5:
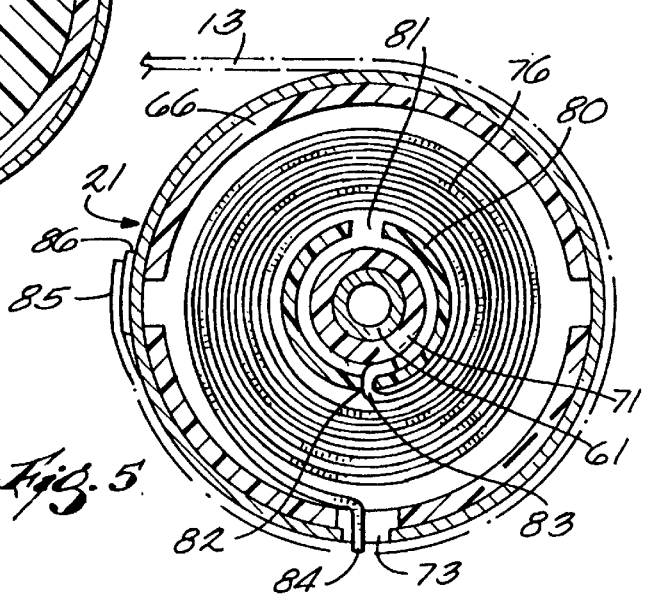
FIG. 5 is a transverse section taken on the line corresponding to the line 5—5 in FIG. 4 and shows an end part of the web, a section through the first roll, a section through the end cap, a spiral spring, the substantially semi-circular elements that extend axially from a worm wheel to provide for attaching the inside end of the spiral spring to the worm wheel while the outside end of the spring is engaged with the end cap, the cylindrical journal of the end cap and the short stationary shaft on which the end cap is journaled.

As illustrated in FIGS. 4 and 5, there are two semicircular elements 80 integral with worm wheel 47 and extending axially from the body of worm wheel 47. The semicircular elements 80 are visualized more easily in FIG. 5 where they are shown to be separated by gaps 81 and 82. FIG. 5 shows how the hooked end 83 of the spiral spring 76 fits through slot 82 and hooks onto semi circular extension 80 to retain the inner end of the spring in a stable position. As is also shown, the end cap 66 is provided with a slot 73 to provide for entry of a tool, not shown, that can engage the outside hooked end 84 of the spiral spring to fit it into the slot 73. Thus, it will be evident that when the worm wheel 47 and its integral semi circular axial extensions 80 rotate together, spiral spring 76 will wind up and store a torsional force for one direction of rotation and will unwind partially to maintain some torsional force when rotated in the opposite direction. As a result of this arrangement, the end cap, and hence, roll 21, is driven rotationally through the agency of the spring which connects at one end to end cap 66 and at the other end to the rotatable semicircular extensions of the worm wheel 47. Spring 76 is preloaded such that it is capable of imparting a torsional force regardless of how the web is distributed or divided between the two rolls. Note in FIG. 5 that the inside end 85 of the web 13 is adhered to the periphery of roll 21 by means of a short strip of tape 86 that has self adhering adhesive on both faces. The tape end could be fastened with single sided adhesive tape if desired.

Figure 8:
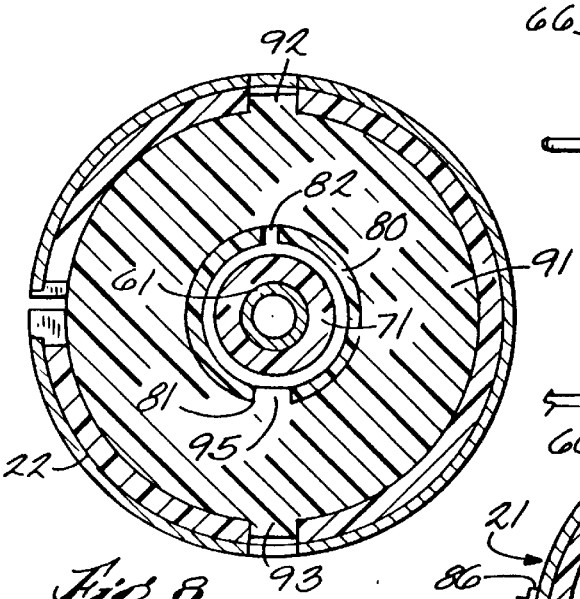
FIG. 8 is a section taken on line 8—8 in FIG. 7 and shows how the semi-circular components that extend axially from a worm wheel are coupled by means of a solid disk in driving relationship with an end cap for a roll.

As shown in FIG. 7, the lower second roll 22 is driven similarly to the tension roll except that a disk 91 replaces the spiral spring and also replaces retaining disks 77 and 78 which are used in the elastically driven tension roll 21. In FIG. 7, the non-elastically driven roll (22) is supported for rotation on a short shaft 61 which is given the same numeral as in FIG. 4 since the shafts are structurally identical. The hexagon head 64 is pressed into a hole in the aluminum frame member 15 to secure shaft 61 in rigid cantilever fashion as previously explained. A second worm wheel that is identified generally by the numeral 48 as it was in connection with FIG. 2 is journaled on nonrotatable shaft 61. The worm for driving the second roll 22 is generally identified by the numeral 46 as it was in connection with FIG. 2. It should be understood, however, that the worms and worm wheels in FIGS. 4 and 7 are preferably identical in all respects to minimize the number of unique parts that are needed to make a module. FIGS. 7 and 8 demonstrate that the solid driving disk 91 for the second roll 22 is provided with radially projecting lugs 92 and 93 that fit into correspondingly shaped slots 74*a* in end cap 66 so that the lugs 92 will apply a rotational force on the end cap which is coupled in driving relationship with roll 22 by way of springy tab 68. It will be evident from FIG. 8 that when the semicircular axially directed extensions 80 of the worm wheel are rotated along with the worm wheel that a radially inwardly directed projecting lug 95 on disk 91 engages in driving relationship with the edges of the gap 81 defined between the two semicircular axial projections 80.

Figure 3:
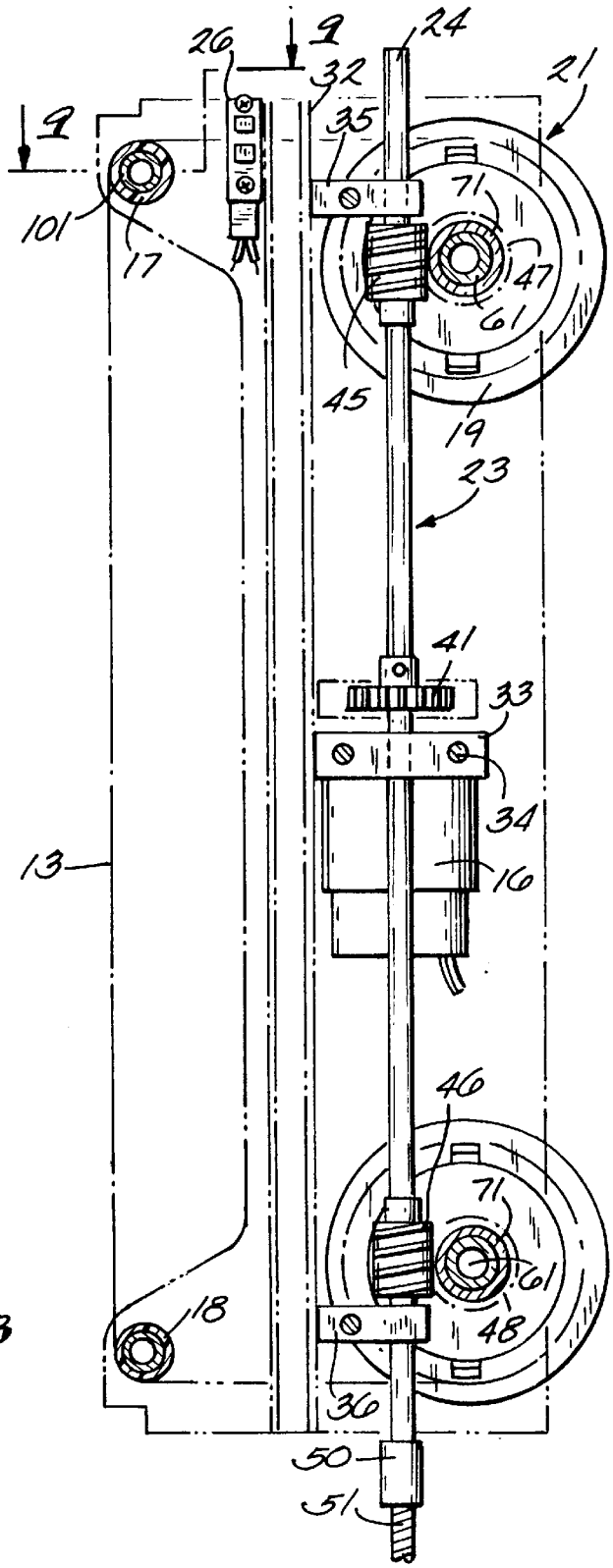
FIG. 3 is a side elevational view taken on a line corresponding to the line 3—3 in FIG. 2 and shows the roll drive system for the module.

It will be evident from inspection of the angulation of the teeth on worms 45 and 46 in FIG. 3 that when main drive shaft 23 is driven in either direction of rotation, the tension or first roll 21 and the cooperating second roll 22 will each be compelled to rotate in the same direction.

As shown in FIG. 3, the web 13 runs over guide rolls 17 and 18 as the web is transferred from the first roll 21 to the second roll 22 and vice versa. As the web transfers, its edge passes between elements of photosensor 26. As shown in FIG. 9, there are code markers 99 located periodically along the edges of web 13 to provide a web position indicative signal. As indicated earlier, an electronic system for determining and controlling web position that could be easily adapted by anyone skilled in the art to the invention disclosed herein is described in U.S. Pat. No. 5,003,717 although other control systems which are well known in the art could be used.

FIG. 9 also shows the manner in which the typical guide roll 17 is supported for rotation. A flanged hub 100 is fitted tightly into the end of roll 17. The hub has a bore which provides for journaling it on a short standoff shaft 101 which has a hexagon head 102 that is pressed into a suitable round hole in side frame member 15 such that the metal surrounding the round hole cold-flows into conformity with the hexagon head 102 and is thereby tightly head side frame member 15. The shaft 101 and its head 102 comprise a standoff that is comparable to either of the standoffs 61 or 62 in general except that the shaft portion 101 is shorter than the former shafts 61 and 62.

The advantages, particularly the necessity, for driving the tension roll through the agency of a spiral spring is described in detail in the previously cited Smith U.S. Pat. No. 734,982 which is incorporated herein by reference.

In summary, a roll sign module has been described that is characterized by driving the two cooperating web winding and unwinding rolls rotationally by having worms fixed on a motor driven main drive shaft and positioned adjacent the rolls, respectively, with their axes disposed transversely to the axes of rotation of the rolls. Power is transferred from the worms to mating worm wheels which are on the axes of rotation of the rolls such that the second of two rolls is driven inelastically from the main drive shaft and the other or first roll, that is, the tension roll, is driven with an elastic connection, namely a spiral spring, connected between the worm wheel that is driven by the worm and the roll itself. The design is distinguished by permitting the rolls to be driven together rotationally by driving the two worms on a main drive shaft under the influence of the electric motor or by turning it manually. The worms can drive the rolls but the converse cannot happen since the worm wheels are blocked against rotation by virtue of their teeth being engaged with the helical teeth of the worms. Thus, when main drive shaft 23 is rotated to any angular position of rotation, rolls 21 and 22 rotate together and when the driving torque applied by way of the main drive shaft 23 is relieved, it becomes impossible for either of the rolls to turn in a direction opposite of the direction in which they were driven which means that there can be no backlash of the tension roll which would allow the web 13 section between guide rolls 17 and 18 to become slack. The module is distinguished further by its capability for driving the rolls manually by using a knob fastened to the main drive shaft or by using a flexible cable fastened to the drive shaft.

We claim:

1. A scroll sign module that translates information bearing web from one roll to another for displaying information, comprising:

first and second laterally spaced apart frame members having insides facing each other, nonrotatable shafts arranged between said frame members with their axes spaced apart and in parallel with each other, first and second rolls arranged for being driven rotationally with their axes coincident with the axes, respectively, of the nonrotatable shafts, the first roll being designated a tension roll, said tension roll and said second roll having corresponding one ends and opposite ends displaced axially from the one ends, respectively, a drive shaft and support members supporting said drive shaft for rotating, said drive shaft having an axis of rotation extending transversely of the axes of the nonrotatable shafts about which the tension roll and the second roll are rotatable, a worm fixed to said drive shaft adjacent each of said one ends of said tension roll and said second roll, a worm wheel mounted for rotating on each of said nonrotatable shafts adjacent said one ends of said rolls and in drivable relation with the worm that is adjacent said one end of the roll, an end cap member drivingly engaged with said one end of the tension roll and another end cap member drivingly engaged with the one end of the second roll, the end cap members being rotatable around said nonrotatable shafts, respectively, a spiral spring arranged concentrically to said nonrotating shaft for the tension roll, said spring having an inner end coupled to the worm wheel adjacent the tension roll and an outer end coupled to said end cap at the one end of the tension roll whereby both ends of said spring are rotatable around one of said nonrotatable shafts, an element for coupling the worm wheel adjacent said second roll to said end cap at said one end of the second roll, and means for supporting said ends opposite of said one ends of the respective rolls for rotation.

2. A sign module according to claim 1 including a reversible electric motor supported from a side frame member of the module proximate said drive shaft and a wheel train coupling said motor to said drive shaft.

3. A sign module according to claim 1 including an element coupled to said drive shaft and adapted for being engaged and turned manually to turn the drive shaft and both worms concurrently.

4. A sign module according to claim 3 wherein said element is a knob fastened to said drive shaft and adapted for being grasped to turn said drive shaft manually.

5. A sign module according to claim 1 wherein said drive shaft has at least one end portion that extends beyond at least one of said worms, and an element that is coupled to said end portion of said drive shaft to provide for being grasped for manually turning said drive shaft.

6. A sign module according to claim 1 wherein said drive shaft has at least one end portion that extends beyond one of said worms, and a cable coupled to said end portion of the drive shaft to provide for being grasped manually for turning said drive shaft.

7. A sign module according to claim 1 including:

a reversible electric motor supported from a side frame member of the module proximate said drive shaft and a wheel train operatively coupling said motor to said drive shaft, and an element coupled to said drive shaft and adapted for being engaged and turned manually to turn said drive shaft and both worms concurrently.

8. A sign module according to claim 7 wherein said element is a knob fastened to said drive shaft.

9. A sign module according to claim 7 wherein said element is an elongate flexible member coupled to said drive shaft and is adapted for being engaged and turned manually to turn said drive shaft and both worms concurrently.

10. A sign module according to claim 1 wherein said nonrotatable shaft about whose axis the tension roll rotates is comprised of first and second unconnected shaft members each of which is comprised of a cylindrical body with the first of the shaft members mounted to one of said laterally spaced apart frame members of the module and the second of the shaft members mounted to the other of the frame members with the axes of the cylindrical bodies being directed toward each other and being coaxial.

11. A sign module according to claim 10 wherein at least one of said cylindrical bodies comprising a shaft member terminates in an integral polygon shaped head having margins terminating in edges defining a polygon shape, said margins extending radially outwardly of the cylindrical body and having an axially extending thickness, said frame member is comprised, in the place where the shaft member is mounted, of a metal plate region having inside and outside surfaces defining a thickness substantially the same as the axial thickness of said polygon shaped head, said head being set in a hole in said plate region and retained therein by metal that is cold-flowed to said edges of said nolygon shaped head while said cylindrical body extends in cantilever fashion from said plate region.

12. A sign module according to claim 11 wherein said margins of the head are flush with said outside surface of the plate region.

13. A sign module according to claim 11 wherein said margins of the head are flush with said inside surface of the plate region.

14. A sign module according to claim 11 where said metal plate region is comprised of aluminum.

15. A sign module according to claim 1 wherein said nonrotatable spaced apart parallel shafts are configured as a single piece that has opposite ends, and said opposite ends of a shaft are fixed, respectively, in said first and second laterally spaced apart frame members.

16. A scroll sign module that translates an information bearing web from one roll to another for displaying information, comprising:

laterally spaced apart members forming a frame, a first roll supported by said frame and a first laterally extending nonrotatable shaft mounted to said frame which provides a laterally directed axis around which said first roll rotates, a second roll supported by said frame and a second laterally extending nonrotatable shaft mounted to said frame which provides a laterally directed axis that is parallel to said axis of the first roll and around which said second roll rotates, a worm wheel journaled for rotation on each of the first and second shafts and elements drivingly coupling each of said worm wheels to a respective one of said rolls, a drive shaft having an axis that extends transversely of the axes of the nonrotatable shaft members for the respective rolls, and bearing elements mounted to said frame supporting the drive shaft for rotation, worms, respectively, fixed on said drive shaft in driving engagement with the worm wheels at said one ends of the rolls to provide for rotating both rolls in the same direction of rotation in response to rotating the drive shaft, and, a spiral spring arranged concentrically to said first nonrotating shaft, said spring having an inner end coupled to the worm wheel adjacent the first roll and an outer end coupled to said first roll whereby both ends of said spring are rotatable around said first nonrotatable shaft.

17. A scroll sign module according to claim 16 including a reversible electric motor mounted to a frame member and wheels coupling said motor in driving relation with said drive shaft.

18. A scroll sign module according to claim 17 wherein said drive shaft has an end portion and an elongated flexible member is connected to said end portion to provide for turning said drive shaft by manually turning the flexible member.

19. A scroll sign module according to claim 16 wherein said drive shaft has an end portion, and an elongated flexible member is connected to said end portion to provide for turning the drive shaft manually by turning the flexible member.

20. A scroll sign module according to claim 16 wherein said drive shaft has an end portion and a knob is fastened to the end portion for being grasped to turn the drive shaft manually.

21. A scroll sign module comprising:

laterally spaced apart side frame members, first and second rolls disposed between said frame members and supported for rotation with their axes extending laterally and parallel with each other, the rolls having corresponding one ends and corresponding opposite ends, and an information bearing web having opposite ends fastened to the respectively rolls, worm wheels arranged adjacent said one ends of said first and second rolls, respectively, and coupled to the rolls with the rotational axis of the wheels coaxial with the rolls, a drive shaft supported on the frame members for rotation around an axis that is transverse to said axes of the worm wheels and the rolls, worms fastened to said drive shaft adjacent said one ends of the first and second rollers, and driving engaged with the worm wheels, and a reversing electronic motor supported on the frame members and operatively coupled to said drive shaft, one of said worm wheels being coupled to said first roll by a spring which has a first end coupled to said worm wheel and an opposite end coupled to said first roll whereby both ends of said spring are rotatable around said axis of said first roll.

22. A scroll sign module according to claim 21 wherein said drive shaft has an end portion and an elongated flexible member is connected to said end portion to provide for turning said drive shaft by manually turning the flexible member.

23. A scroll sign module according to claim 21 wherein said drive shaft has an end portion and a knob is fastened to the end portion for being grasped to turn the drive shaft manually.

* * * * *